US006055912A

United States Patent [19]

Doud et al.

[11] Patent Number: 6,055,912

[45] Date of Patent: May 2, 2000

[54] ADJUSTABLE HEIGHT TABLE

[75] Inventors: Galen C. Doud, Kent; Cory J. Sytsma, Bellevue; Paul M. Chen, Seattle, all of Wash.

[73] Assignee: HON Technology Inc., Muscatine, Iowa

[21] Appl. No.: 09/165,726

[22] Filed: Oct. 2, 1998

[51] Int. Cl.[7] ..... A47B 9/00

[52] U.S. Cl. ..... 108/110; 248/250; 108/147.17

[58] Field of Search ..... 211/183, 187; 248/239, 242, 250, 243; 108/109, 110, 64, 147.17

[56] References Cited

U.S. PATENT DOCUMENTS

| | | | |
|---|---|---|---|
| 327,413 | 9/1885 | Rohrbach . | |
| 388,066 | 8/1888 | Murphy | 108/110 |
| 1,395,166 | 10/1921 | Tomlinson . | |
| 2,591,797 | 4/1952 | Exline et al. . | |
| 3,217,673 | 11/1965 | Knoblock . | |
| 3,771,466 | 11/1973 | Ferdinand et al. | 108/109 |
| 5,004,201 | 4/1991 | Bessinger . | |
| 5,174,225 | 12/1992 | Reise et al. . | |
| 5,297,486 | 3/1994 | Herrmann et al. . | |
| 5,354,027 | 10/1994 | Cox . | |
| 5,406,894 | 4/1995 | Herrmann et al. . | |
| 5,497,597 | 3/1996 | Elzenbeck . | |
| 5,544,593 | 8/1996 | Canfield et al. | 108/110 |
| 5,549,055 | 8/1996 | Kusch . | |
| 5,606,920 | 3/1997 | Meyer et al. | 108/64 |

*Primary Examiner*—Peter M. Cuomo
*Assistant Examiner*—Jerry A. Anderson
*Attorney, Agent, or Firm*—Jones, Day, Reavis & Pogue

[57] ABSTRACT

An adjustable height table includes a pair of spaced upright support members each having an upper free end and a lower end, with the lower ends each connected to a pair of leg members. A work surface is disposed between the support members. A pair of forwardly extending brackets and a pair of rearwardly extending brackets are each adjustable mounted to the support members and the work surface is connected to the brackets by manually operable latches. The work surface is thereby height adjustable by adjusting the positions of the brackets on the support members and the entire assembly may be packaged and shipped in essentially flat form and easily assembled without tools at its shipped destination.

5 Claims, 6 Drawing Sheets

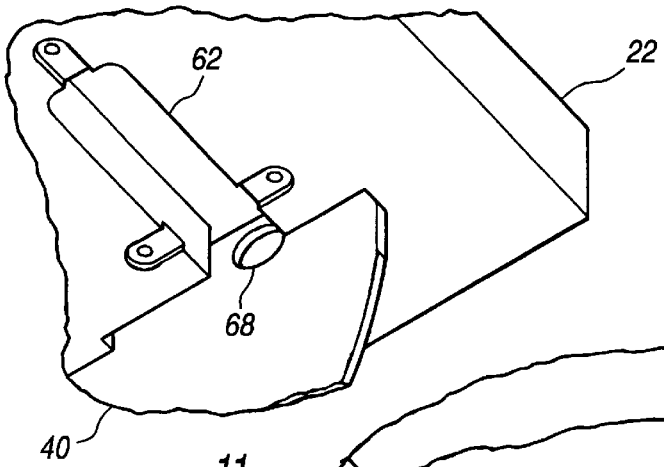
FIG. 9
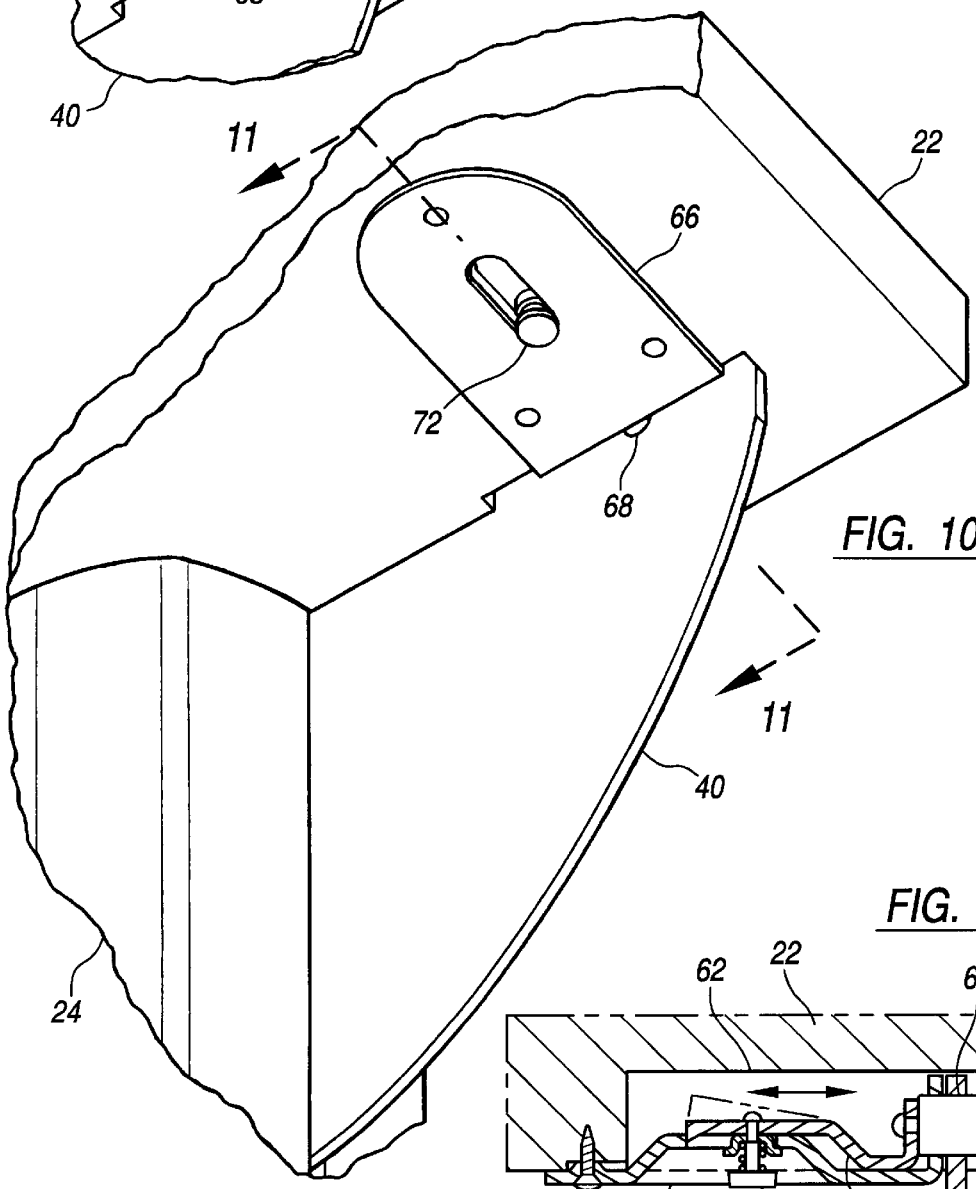
FIG. 10
FIG. 11
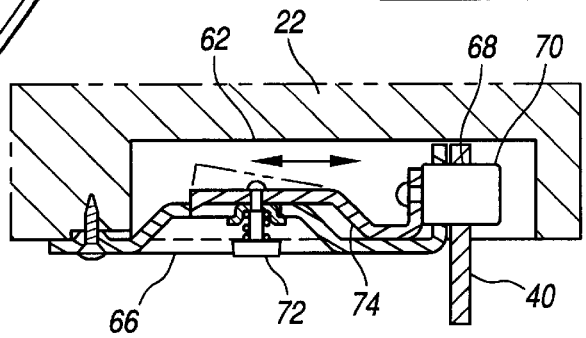

ADJUSTABLE HEIGHT TABLE

BACKGROUND OF THE INVENTION

1. Field of the Invention

The present invention relates generally to an adjustable height table and, more particularly, to a table which can be used as a workstation with a computer terminal or the like, which can be conveniently adjusted in height to suit the needs of the user and which can be conveniently shipped in knocked-down form and readily assembled at its destination by the user.

2. Description of the Related Art

With the advent of the personal computer, numerous types of furniture components have become available at which the computer user can be seated comfortably to use a keyboard and other peripherals and also view a monitor. Often such furniture is preassembled in manufacture having only a single predetermined work surface height. As a consequence, the furniture can be uncomfortable to be seated at over extended periods of time because the work surface may not be positioned at a suitable height or the particular user.

Furniture such as tables, for example, are usually very bulky items with much of their bulk taken up with space. As a consequence, these items are relatively expensive to ship from their point of manufacture to the ultimate consumer. Also, many forms of table are easily damaged in shipment. Accordingly, the manufacturer must go the some lengths to adequately protect them with suitable packaging to anticipate possible damage in shipment.

Furniture is available which can be shipped disassembled for assembly by the consumer. In fact, such furniture has become popular in recent times, largely because it can be manufactured and shipped relatively inexpensively and resulting cost savings can be passed on to the consumer. In addition, growing numbers of consumers are generally becoming accustomed to purchasing merchandise of all kinds in unassembled form and then assembling it at the desired destination. As a result, many items can be purchased today which have been specifically designed to be easily assembled at their destinations by persons having even modest mechanical abilities and few tools.

Accordingly, it is desirable to provide a table suitable for use with a computer terminal which has a work surface that is easily height adjustable. It is further desirable to provide such a table wherein components of the table can be packaged such that they can be economically shipped and are resistant to damage. It is further desirable to provide such a table which can be easily assembled at its intended destination and is sturdy in construction when assembled.

SUMMARY OF THE INVENTION

The present invention improves over the prior art by providing an adjustable height table including a pair of spaced upright support members each having an upper free end and a lower end, with the lower ends each connected to a pair of leg members. A work surface is disposed between the support members. A pair of forwardly extending brackets and a pair of rearwardly extending brackets are each adjustably mounted to the support members and the work surface is connected to the brackets by manually operable latches. The work surface is thereby height adjustable by adjusting the positions of the brackets on the support members and the entire assembly may be packaged and shipped in essentially flat form and easily assembled without tools at its shipped destination.

BRIEF DESCRIPTION OF THE DRAWINGS

The foregoing and other novel features and advantages of the invention will be better understood upon a reading of the following detailed description taken in conjunction with the accompanying drawings wherein:

FIG. 9 is a fractional perspective view showing a portion of a bracket as being installed in a work surface;

FIG. 10 is a fractional perspective view showing a portion of a work surface as being installed with a latch;

FIG. 11 is a cross-sectional view taken substantially along the line 11—11 of FIG. 10;

DETAILED DESCRIPTION OF THE PREFERRED EMBODIMENT

Figure 1:
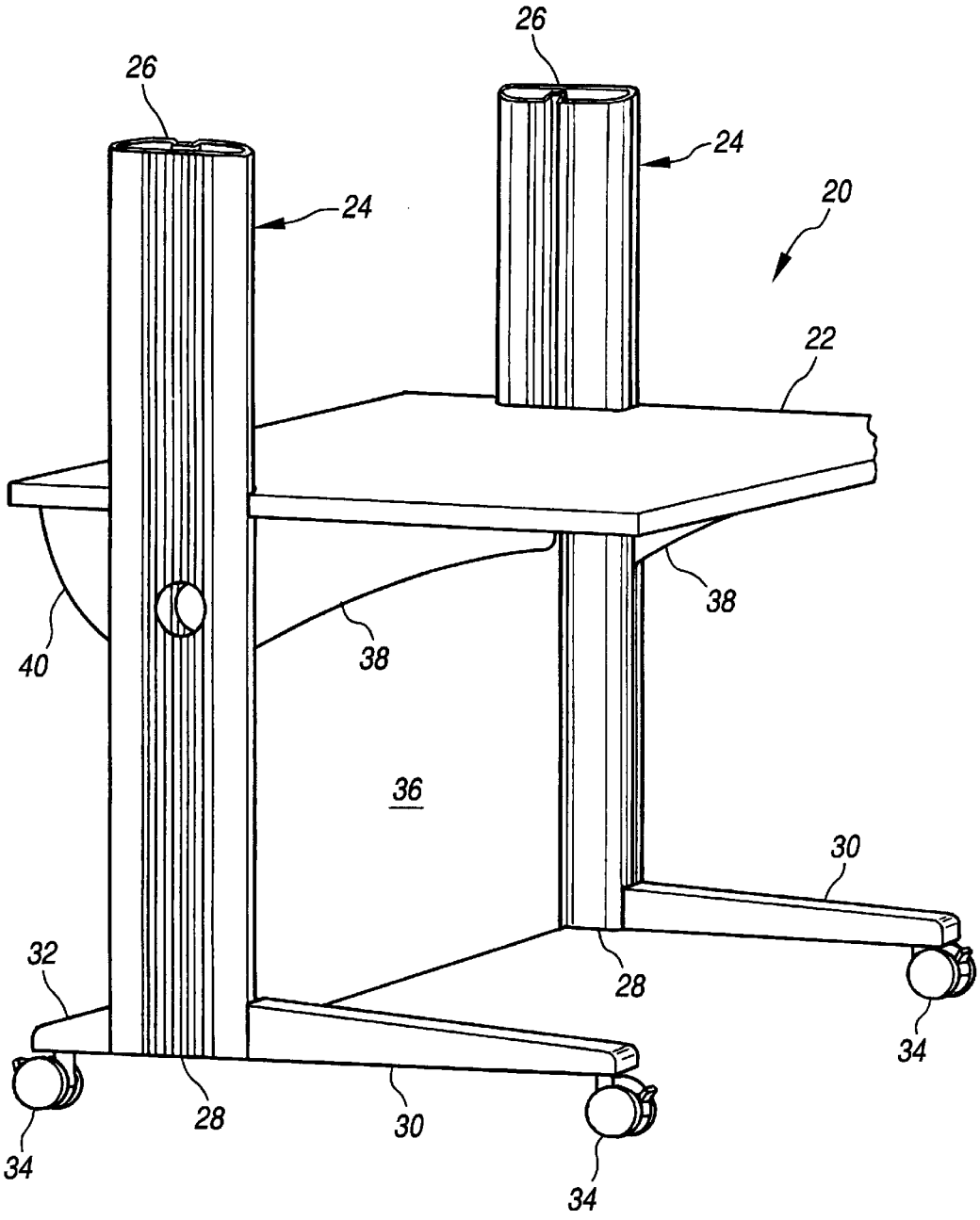
FIG. 1 is a left front perspective view of an adjustable height table constructed in accordance with the principles of the invention.

Referring now to the drawings, and initially to FIG. 1, an adjustable height table constructed in accordance with the principles of the invention is designated generally by the reference numeral 20 and includes as a principal component a generally horizontal work surface 22 supported by a pair of spaced upright support members 24. The support members 24 are preferably extruded from a suitable aluminum material and have upper free ends 26. Lower ends 28 of the support members 24 are connected to forwardly directed legs 30 and rearwardly directed legs 32. The legs 30 and 32 may be provided with casters 34 so that the table 20 may be easily moved about. A modesty panel 36 is connected between the support members 24. In accordance with the invention, and as will be described hereinafter in detail, the work surface 22 is connected to the upright support members 24 by forwardly directed brackets 38 and rearwardly directed brackets 40.

Figure 2:
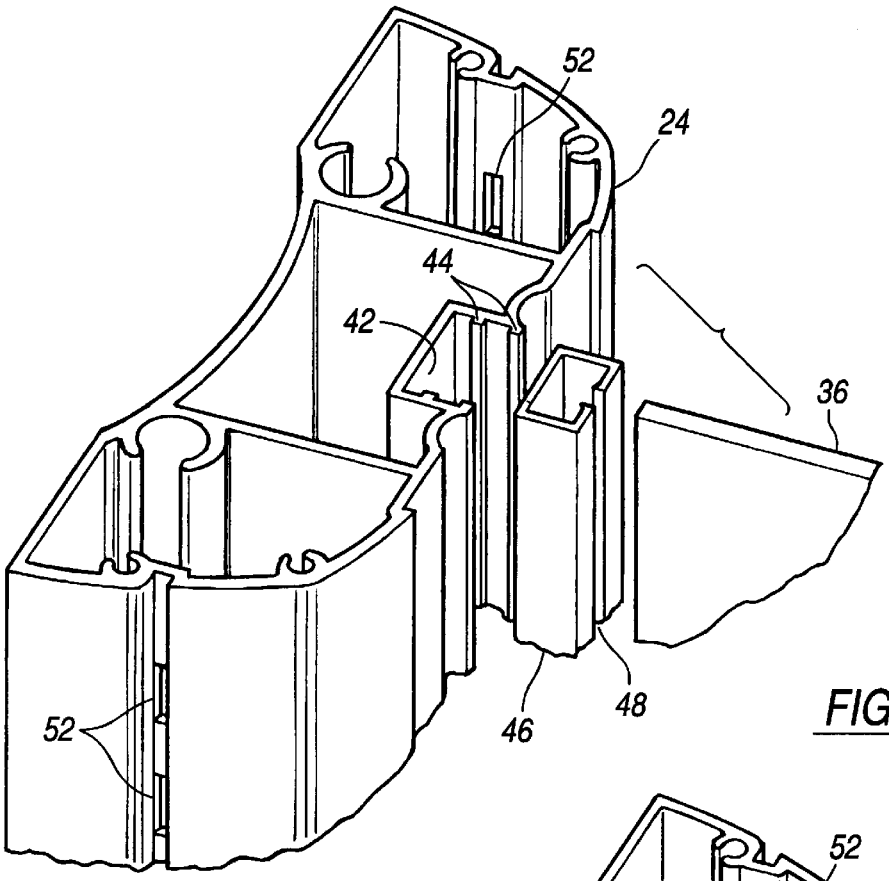
FIG. 2 is a fractional exploded perspective view of an upright support member shown with an associated modesty panel.
Figure 3:
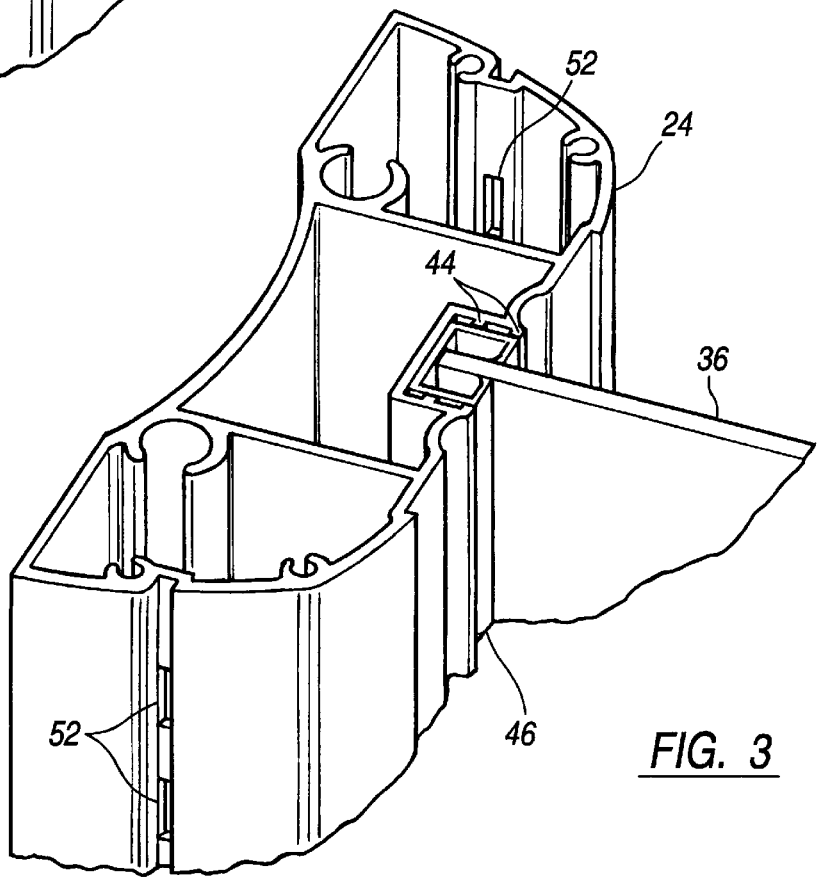
FIG. 3 is a fractional perspective view of an upright support member shown with the modesty panel assembled.

Turning now to FIGS. 2 and 3, the modesty panel 36 is shown as being connected to a support member 24. To accomplish the connection, the support member 24 is provided with a longitudinally extending U-shaped channel 42 provided with ribs 44. A C-shaped member 46 has a longitudinal slot 48 dimensioned to snugly receive an edge of the modesty panel 36. Once the modesty panel 36 is inserted into the slot 48, the member 46 is pressed into the channel 42 and the ribs 44 tend to compress the slot 48 thereby holding the panel 36 firmly to the upright support member 24.

Figure 4:
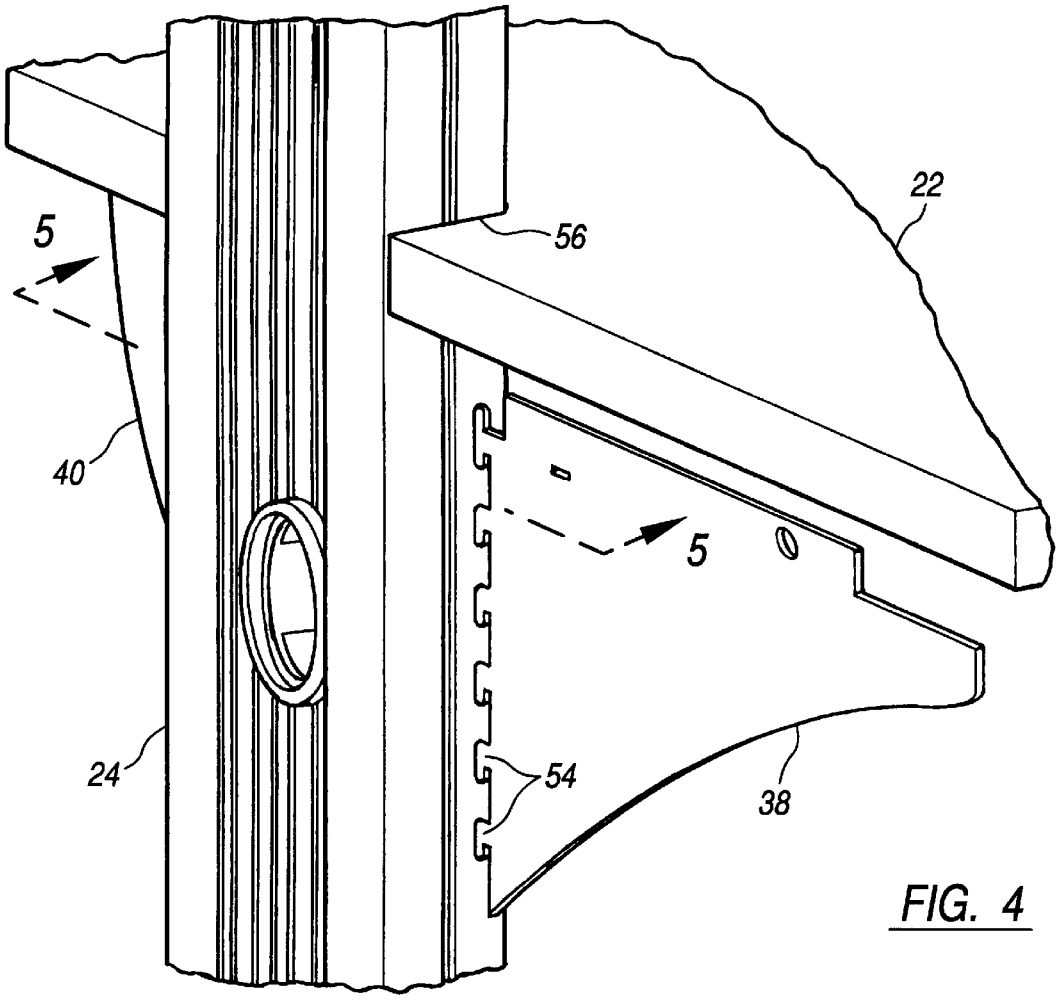
FIG. 4 is a fractional exploded perspective view of an upright support member and associated brackets and work surface.
Figure 5:
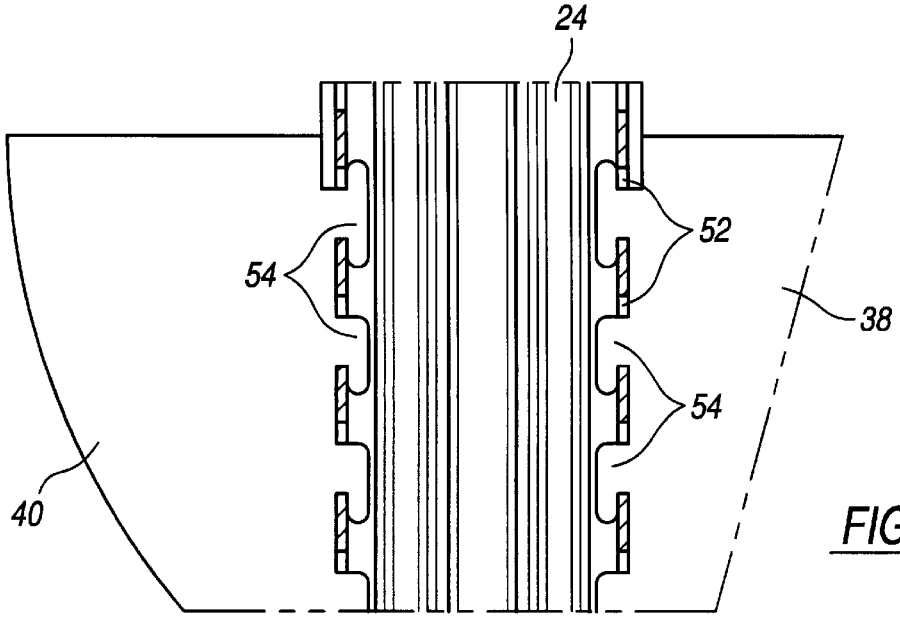
FIG. 5 is a cross-sectional view taken substantially along the line 5—5 of FIG. 4.

Referring to FIGS. 4 and 5, the support members 24 can be seen as provided with a vertical series of uniformly spaced slots 52 (see also FIGS. 2 and 3) into which hook portions 54 of the brackets 38 and 40 may be inserted and moved downwardly thereby locking the brackets 38 and 40 to the support members 24. It is also noted that the work surface 22 is provided with cut-out regions 56 which receive the support members 24 such that the work surface 22 may overlie the brackets 38 and 40.

Figure 6:
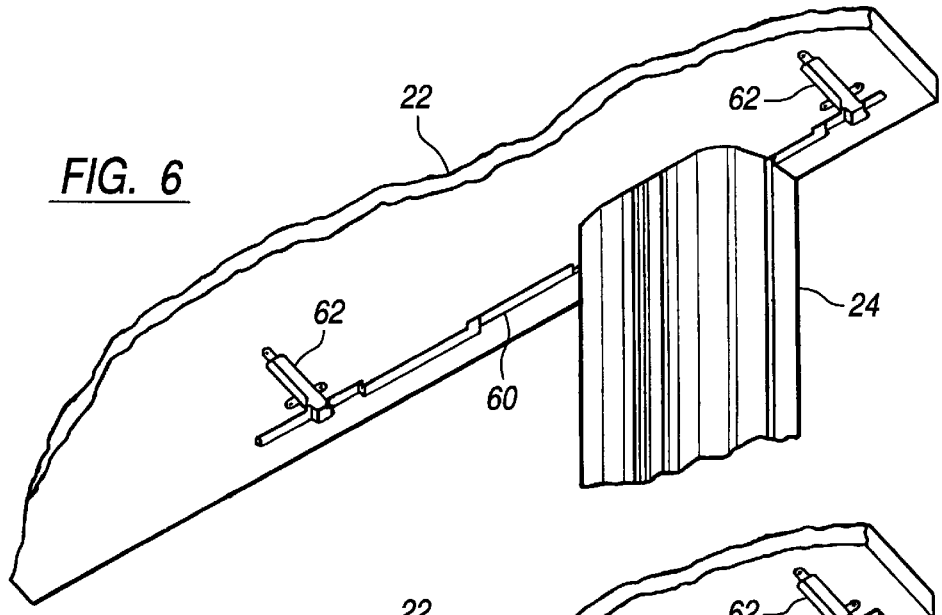
FIG. 6 is a fractional perspective view of the underside of a work surface shown without hardware used to attach the work surface to an upright support member.
Figure 7:
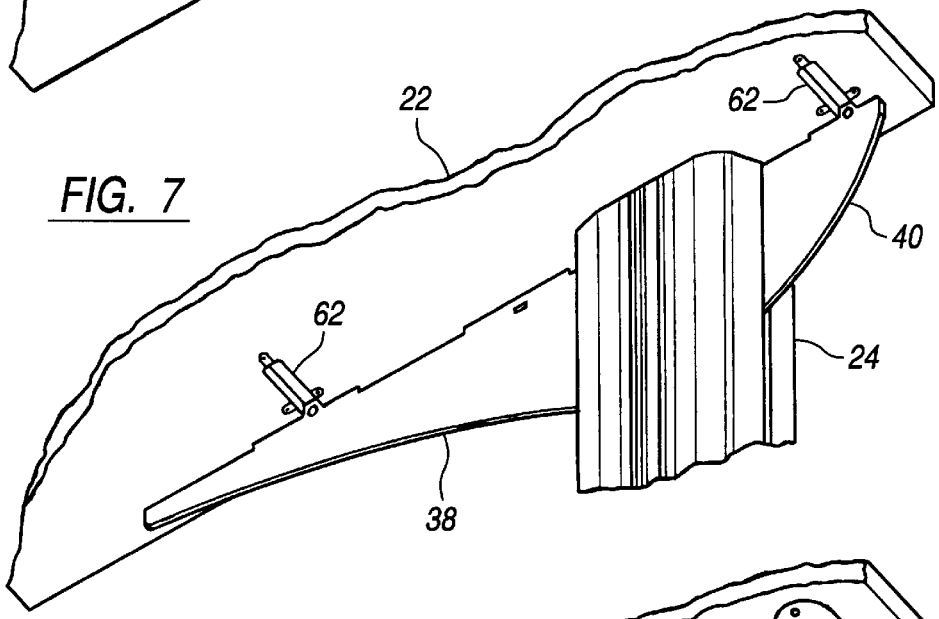
FIG. 7 is a fractional perspective view of the underside of a work surface shown with support brackets.
Figure 8:
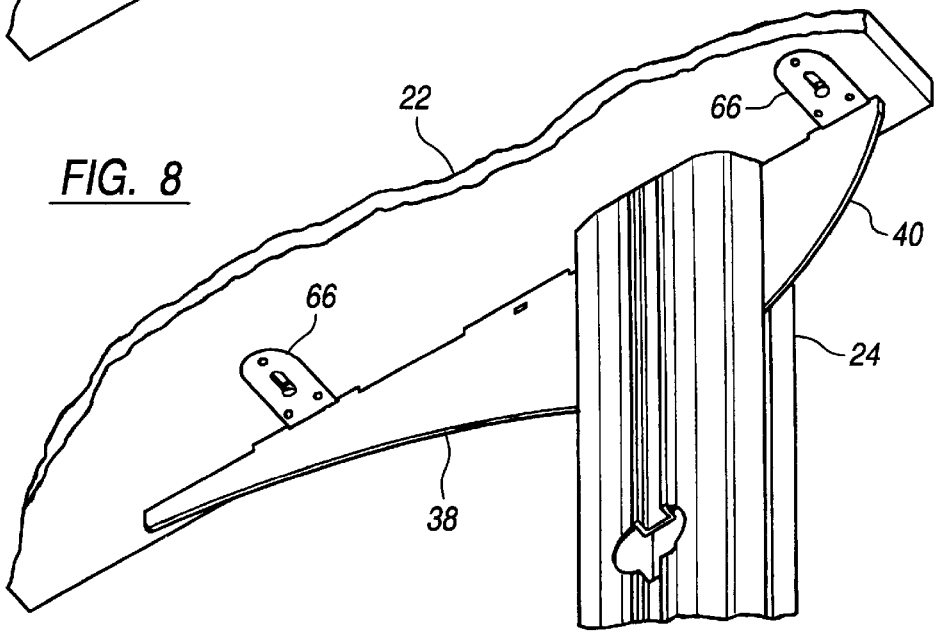
FIG. 8 is a fractional perspective view of the underside of a work surface shown with the work surface attached to upright support member.
Figure 12:
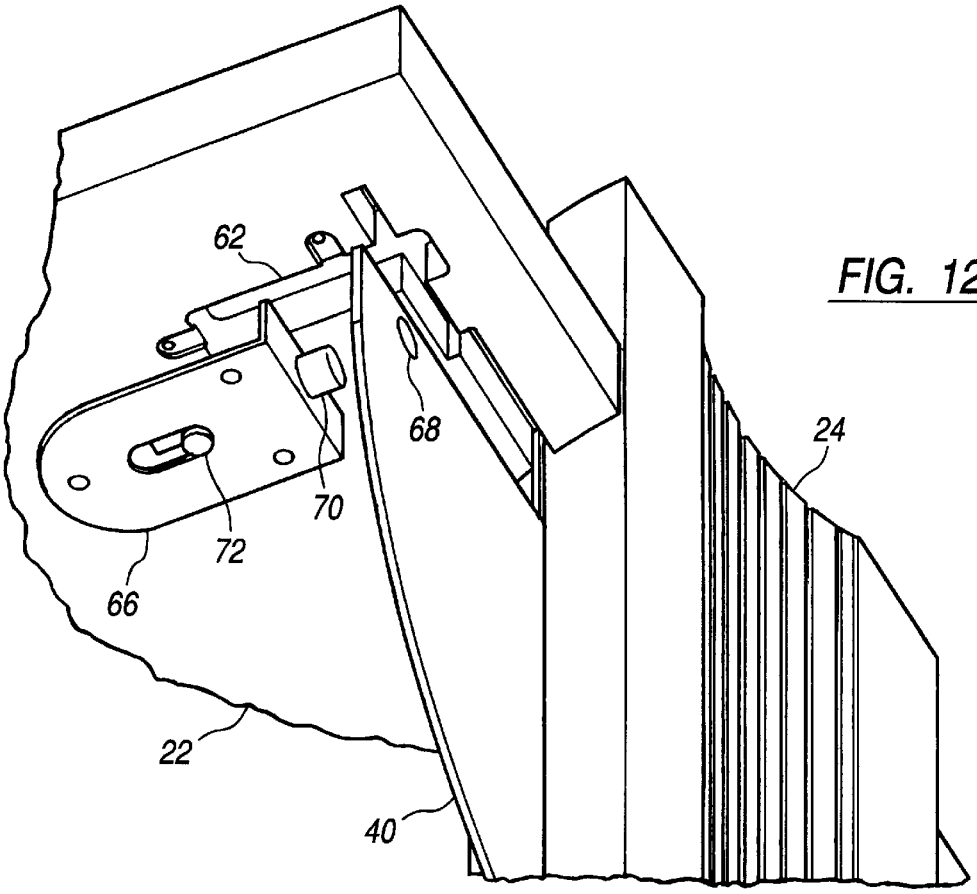
FIG. 12 is a fractional, exploded perspective view showing the connection of the work surface to an upright support member.
Figure 13:
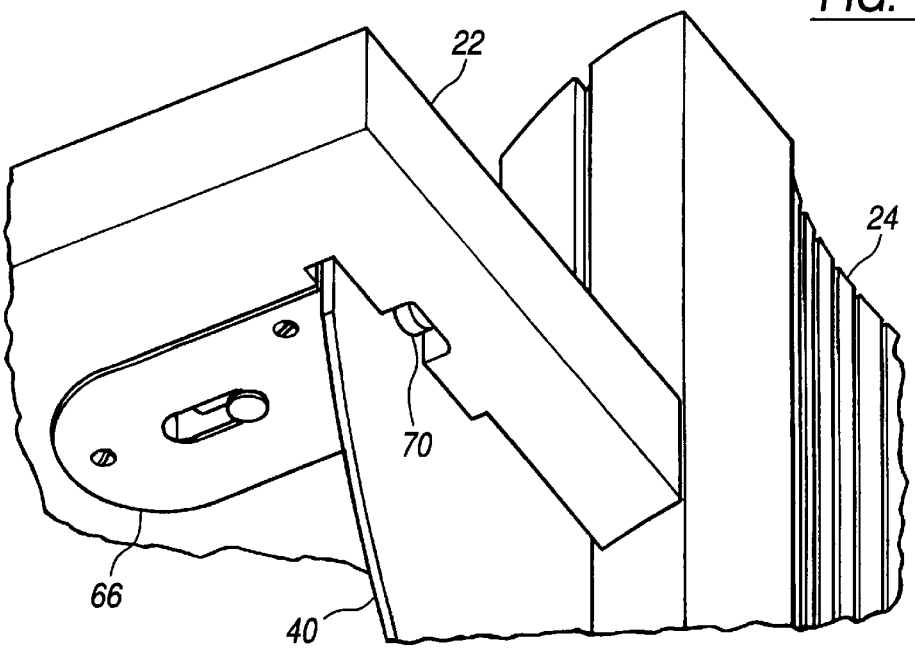
FIG. 13 is a fractional perspective view showing the connection of the work surface to an upright support member.

FIGS. 6–8 show the cooperation of the brackets 38 and 40 with the work surface 22. To support the work surface 22, a pair of longitudinal slots 60 are provided along opposed edges of the underside of the work surface 22 and are dimensioned and configured to receive edges fo the brackets 38 and 40. Adjacent the slots 60 and extending at right angles therefrom are pairs of recesses 62 which are configured to receive latches 66. FIG. 9 shows the details of a recess 62 and also shows that the brackets 38 and 40 are provided with apertures 68 aligned with each recess 62. When the brackets 38 and 40 are installed with respect to the work surface 22 as shown in FIGS. 10 and 11, for example, a pin 70 of each latch 66 extends through a respective aperture 68 and locks the brackets 38 and 40 in the slots 60. The pins 70 may be operated to either lock-in the brackets 38 and 40 or release them by manually operating a button 72 attached to a simple slide member 74 internal to each latch 66. FIGS. 12 and 13 illustrate in detail the locking action of the latches 66.

It can now be appreciated that a table 20 constructed according to the invention offers considerable advantages over preassembled tables particularly of the type used with computer equipment. The table 20 may be readily manufactured from simple components and can be shipped conveniently in knock-down form thereby offering cost savings to the consumer. Because of its novel latch 66 and bracket 38 and 40 construction, the table 20 is provided with a simple and cost-effective means of assembly, which also provides for convenient height adjustability of the work surface 22. To adjust the height of the work surface 22 after the table has ben assembled, the user need only release the latches 66 by simple manual movement of the latch buttons 72 thereby retracting the pins 70 from the apertures 68 of the brackets 38 and 40. This releases the work surface 22 such that it can be removed. Next, the brackets 38 and 40 can be installed in any one of series of mounted positions on the support members 24 and the work surface 22 may thereafter be reinstalled.

While the present invention has been described in connection with a preferred embodiment thereof, it will be apparent to those skilled in the art that many changes and modifications may be made without departing from the true spirit and scope of the present invention. Accordingly, it is intended by the appended claims to cover all such changes and modifications as come within with the spirit and scope of the invention.

What is claimed is:

1. An adjustable height ready-to-assemble table comprising:

a pair of spaced upright support members each having an upper free end and a lower end, said lower ends each being connected to a leg member;

a work surface disposed between said support members;

a pair of forwardly projecting brackets each adjustably mounted to one of said support members;

a pair of rearwardly projecting brackets each adjustable mounted to one of said support members;

a pair of slots formed along opposed edges of an underside of said work surface, said slots being dimensioned and configured to slidingly receive said brackets;

a plurality of downwardly open recesses in said underside of said work surface; and a plurality of manually movable bolt assemblies each received in a respective one of said recessed and each being cooperable with an aperture formed in a respective one of said brackets to retain said brackets in said slots.

2. The table of claim 1 wherein said support members include a plurality of spaced slots and said brackets are provided with hook portions which are received in said slots.

3. The table of claim 1 including a modesty panel connecting said support members.

4. The table of claim 3 wherein said modesty panel is received in channels formed in said support members.

5. An adjustable height table comprising:

a pair of spaced upright support members each having an upper free end and a lower end, said lower ends each being connected to a leg member;

a work surface disposed between said support members;

a pair of forwardly projecting brackets each adjustable mounted to one of said support members;

a pair of rearwardly projecting brackets each adjustable mounted to one of said support members; and a modesty panel received in channels formed in said support members;

wherein said modesty panel is provided with generally C-shaped members and opposed edges of the panel are received in slots formed in the C-shaped members, and wherein said channels are provided with internal ribs that serve to compress said slots when said panel and C-shaped members are inserted into said channels.

* * * * *